US007289963B2

(12) United States Patent
Iwasaki et al.

(10) Patent No.: US 7,289,963 B2
(45) Date of Patent: Oct. 30, 2007

(54) SOUND-REPRODUCING APPARATUS AND HIGH FREQUENCY INTERPOLATION-PROCESSING METHOD

(75) Inventors: Masao Iwasaki, Tokyo (JP); Isao Kaneko, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/488,829

(22) Filed: Jul. 19, 2006

(65) Prior Publication Data

US 2007/0216546 A1 Sep. 20, 2007

(30) Foreign Application Priority Data

Mar. 17, 2006 (JP) ..... 2006-075542

(51) Int. Cl.
*G10L 19/00* (2006.01)

(52) U.S. Cl. ..... 704/500; 704/503; 341/50

(58) Field of Classification Search ..... 704/500, 704/503, 229, 230, 200.1; 341/50, 51
See application file for complete search history.

(56) References Cited

U.S. PATENT DOCUMENTS 5,619,197 A * 4/1997 Nakamura ..... 341/50
5,619,558 A * 4/1997 Jheeta ..... 379/92.01
5,956,674 A * 9/1999 Smyth et al. ..... 704/200.1
5,974,380 A * 10/1999 Smyth et al. ..... 704/229
5,978,762 A * 11/1999 Smyth et al. ..... 704/229
6,388,959 B1 * 5/2002 Kondo ..... 369/30.19
6,487,535 B1 * 11/2002 Smyth et al. ..... 704/500
6,928,060 B1 * 8/2005 Kikuchi ..... 370/265
7,140,037 B2 * 11/2006 Tsutsui et al. ..... 726/2
2005/0238185 A1 * 10/2005 Suzuki ..... 381/106

FOREIGN PATENT DOCUMENTS

JP 2004-198485 7/2004

* cited by examiner

*Primary Examiner*—Linh Nguyen
(74) *Attorney, Agent, or Firm*—Pillsbury Winthrop Shaw Pittman LLP

(57) ABSTRACT

The invention provides a sound-reproducing apparatus and a high frequency interpolation-processing method in each of which high frequency interpolation processing having a light burden imposed thereon can be executed. Compressed audio data is decoded by a decoder (202*a*) and the resulting audio signal is transmitted to a harmonizer (209*a*). Auxiliary information such as a sampling rate and a bit rate contained in the decoded audio signal is read out by a header reader (209*b*) and is transmitted to a harmonizer (209*a*). Communication of signals from/to respective portions is made through a bus (210). The harmonizer (209*a*) has a preset for an interpolation band obtained in accordance with a format and a sampling frequency of the compressed audio data, and executes processing by referring to file information transmitted thereto from the header reader (209*b*).

13 Claims, 6 Drawing Sheets

SOUND-REPRODUCING APPARATUS AND HIGH FREQUENCY INTERPOLATION-PROCESSING METHOD

The present invention is based on Japanese patent application No. 2006-075542, the entire contents of which are incorporated herein by reference.

BACKGROUND

1. Field

One embodiment of the invention relates to a sound-reproducing apparatus for reproducing compressed audio data having MP3 or the like, and more particularly to a sound-reproducing apparatus for executing interpolation processing for high frequencies during sound reproduction, and a high frequency interpolation-processing method for use therein.

2. Description of the Related Art

A frequency sample interpolator which reads out auxiliary information of compressed audio data, and specifies a band of high frequency components which are lacked when compression processing is executed, thereby interpolating the lacked high frequency components has been known as a conventional art. This frequency sample interpolator, for example, is disclosed in the Japanese Patent Kokai No. 2004-198485.

According to this frequency sample interpolator, in the case of, for example, MPEG-1 or AUDIO Layer2, an amount of data allocated, for each band, which is contained in the auxiliary information is read out, or in the case of, for example, MPEG-2 or AUDIO NBC, scale factor band information representing the highest band having frequency components existing therein is read out, whereby it is possible to specify a precise signal lack band.

However, according to the conventional frequency sample interpolator, the auxiliary information must be read out every frame constituted by a predetermined number of samples, and thus the auxiliary information must be analyzed. As a result, an operation process becomes complicated and thus a large burden is imposed on processing.

BRIEF DESCRIPTION OF THE SEVERAL VIEWS OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION OF PREFERRED EMBODIMENTS

Figure 1:
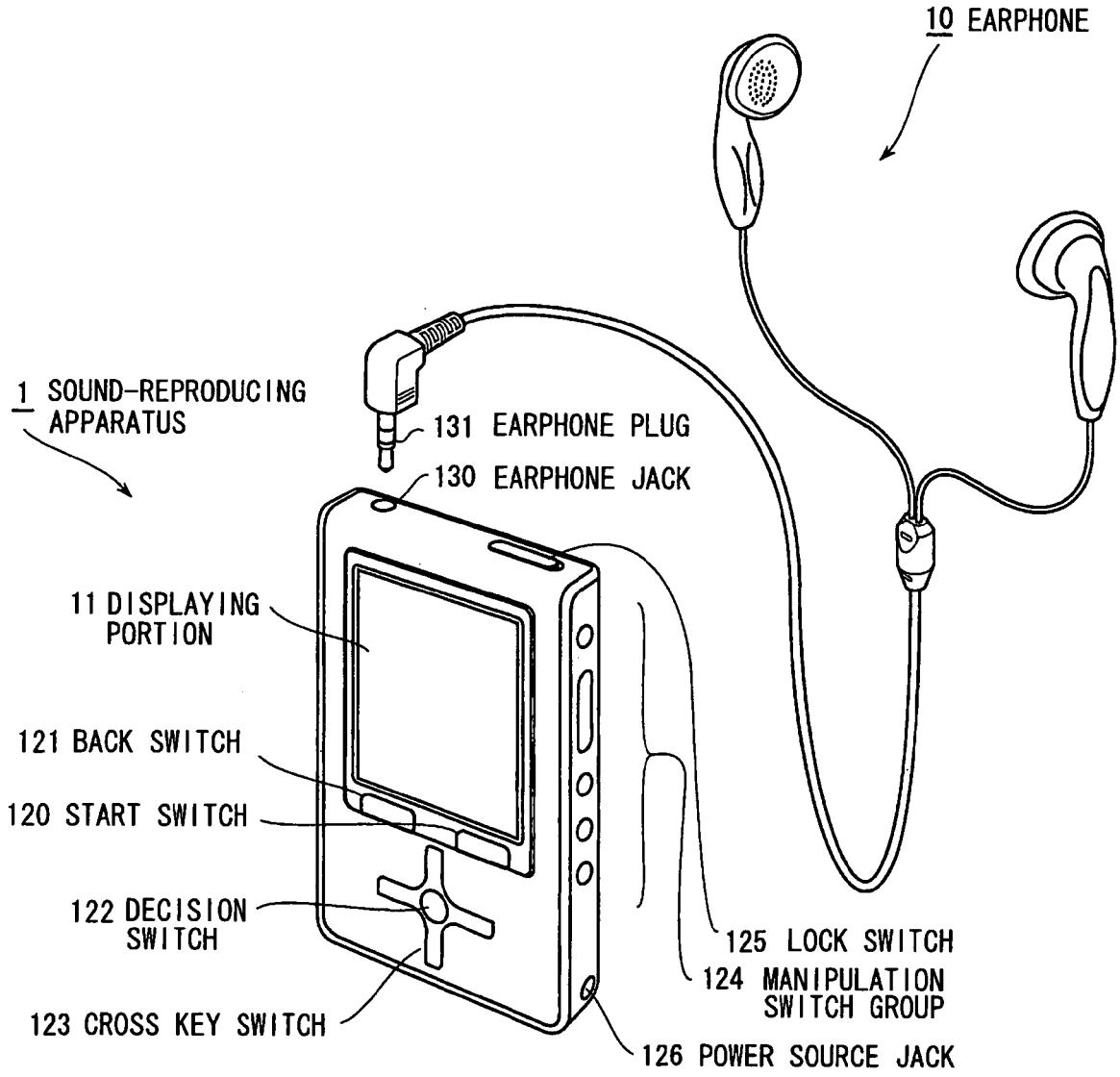
FIG. 1 is an exemplary perspective view of a sound-reproducing apparatus according to a first embodiment of the present invention.

Various embodiments according to the invention will be described hereinafter with reference to the accompanying drawings. In general, according to one embodiment of the invention, there is provided a sound-reproducing apparatus, including: a decoder for converting compressed audio data into an audio signal; a header reader for reading file information from the compressed audio data; and a harmonizer for receiving the file information from the header reader, selecting a preset interpolation band by referring to the file information, and executing high frequency interpolation processing with respect to the interpolation band thus selected.

According to this constitution, since the interpolation band corresponding to the file information is set in advance, the high frequency interpolation processing can be executed by reading out the file information only once for one file. As a result, it is possible to reduce the operation required for the high frequency interpolation processing.

In addition, according to one embodiment of the invention, there is provided a sound-reproducing apparatus, including: a decoder for converting compressed audio data into an audio signal; a header reader for reading file information containing a file format and a sampling frequency from the compressed audio data; and a harmonizer for receiving the file information from the header reader and executing high frequency interpolation processing with respect to a preset interpolation band in accordance with the file information.

According to this constitution, the high frequency interpolation processing can be executed by reading out information on the file format and information on the sampling frequency. As a result, it is possible to reduce the operation required for the high frequency interpolation processing.

In addition, according to one embodiment of the invention, there is provided a sound-reproducing apparatus, including: a decoder for converting compressed audio data into an audio signal; a header reader for reading file information from the compressed audio data; a sampling rate converter for converting the audio signal into another audio signal having a fixed sampling frequency in accordance with the file information; and a harmonizer for subjecting the audio signal received from the sampling rate converter to high frequency interpolation processing with respect to a preset interpolation band.

According to this constitution, since the sampling frequency of the audio signal is converted into the fixed value, the interpolation processing by the harmonizer can be executed in accordance with a simple setting, and thus a burden imposed on the high frequency interpolation processing is lightened.

In addition, according to one embodiment of the invention, there is provided a sound-reproducing apparatus, including: a decoder for converting compressed audio data into an audio signal; an FFT analyzer for determining an interpolation band by Fourier-transforming the audio signal; and a harmonizer for receiving information on the interpolation band from the FFT analyzer and executing high frequency interpolation processing in accordance with the interpolation band.

According to this constitution, since the FFT analyzer analyzes the audio signal on a real time basis, it is possible to cope with a compressed audio file containing a variable bit rate.

In addition, according to one embodiment of the invention, there is provided a sound-reproducing apparatus, including: a decoder for converting compressed audio data containing a fixed bit rate into a first audio signal and converting compressed audio data containing a variable bit rate into a second audio signal; a header reader for reading file information from the compressed audio data containing the fixed bit rate; a sampling rate converter for converting the first audio signal into a third audio signal having a fixed sampling frequency in accordance with the file information; an FFT analyzer for determining a first interpolation band by Fourier-transforming the second audio signal; and a harmonizer for subjecting the third audio signal to high frequency interpolation processing with respect to a preset second interpolation band and subjecting the second audio signal to high frequency correction processing in accordance with the first interpolation band information on which is received from the FFT analyzer.

According to this construction, since the configuration used is put to proper use depending on kinds of compressed audio data, the precise high frequency interpolation processing can be executed, and at the same time, it is possible to lighten a burden imposed on the processing.

In addition, according to one embodiment of the invention, there is provided a high frequency interpolation-processing method, including the steps of: decoding compressed audio data into an audio signal by a decoder; reading a header contained in the compressed audio data by a header reader; selecting a preset interpolation band by referring to information described in the header by a control portion; and executing high frequency interpolation processing with respect to the interpolation band thus selected.

According to this method, since the interpolation band can be determined by the header, no complicated processing is required, and thus a simple operation becomes possible.

In addition, according to one embodiment of the invention, there is provided a high frequency interpolation-processing method, including the steps of: decoding compressed audio data into an audio signal by a decoder; reading a header contained in the compressed audio data by a header reader; converting a sampling rate for the audio signal into a fixed value by referring to information described in the header; and executing high frequency interpolation processing with respect to an interpolation band suitable for the fixed value.

According to this method, since the audio signal is converted into the signal having a single sampling frequency, the high frequency interpolation processing can be executed in accordance with a single setting, and thus the processing becomes simple.

Also, according to one embodiment of the invention, there is provided a high frequency interpolation-processing method, including the steps of: decoding compressed audio data into an audio signal by a decoder; determining an interpolation band by Fourier-transforming the audio signal to analyze frequency components of the audio signal; and executing high frequency interpolation processing with respect to the interpolation band thus determined.

According to this method, since performing the Fourier transform allows the frequency components to be analyzed on a real time basis, it is possible to specify a lower limit value of the interpolation band which changes with time, and it is possible to cope with the compressed audio data containing the variable bit rate.

Also, according to one embodiment of the invention, there is provided a high frequency interpolation-processing method, including the steps of: decoding compressed audio data containing a fixed bit rate into a first audio signal by a decoder and decoding compressed audio data containing a variable bit rate into a second audio signal by the decoder; reading a header contained in the compressed audio data containing the fixed bit rate by a header reader; converting the first audio signal into a third audio signal having a fixed sampling rate by referring to information described in the header; determining a first interpolation band by Fourier-transforming the second audio signal to analyze frequency components of the second audio signal; and subjecting the third audio signal to high frequency interpolation processing with respect to a second interpolation band suitable for the fixed value and subjecting the second audio signal to the high frequency interpolation processing with respect to the first interpolation band.

According to this method, since the different interpolation-processing methods are carried out for the compressed audio data containing the fixed bit rate and the compressed audio data containing the variable bit rate, respectively, it is possible to execute the precise processing having a light burden imposed thereon.

According to the present invention, the high frequency interpolation in which the burden imposed on the processing is lightened can be performed in the sound-reproducing apparatus.

First Embodiment

FIG. 1 is a perspective view of a sound-reproducing apparatus 1 according to a first embodiment of the present invention.

The sound-reproducing apparatus 1 includes electronic components such as a central processing unit (CPU) and a miniature hard disc drive (HDD) in its inside, and includes a displaying portion 11 for displaying thereon characters, an image or the like, and a start switch 120, a back switch 121, a decision switch 122 and a cross key switch 123 with which displayed items are manipulated in its front. In addition, the sound-reproducing apparatus 1 includes a manipulation switch group 124 having a power source switch, a volume switch and the like, and a power source jack 126 through which a power can be supplied from the outside to the sound-reproducing apparatus 1 in its right-hand surface. Also, the sound-reproducing apparatus 1 includes an earphone jack 120 and a lock switch 125 on its upper surface, and includes a USB terminal and an extension connector (which are not shown in the figure) on its lower surface.

The earphone 10 has an earphone plug 131. The earphone plug 131 is plugged into the earphone jack 130 to be connected thereto, thereby allowing a sound to be outputted through the earphone 10.

Figure 2:
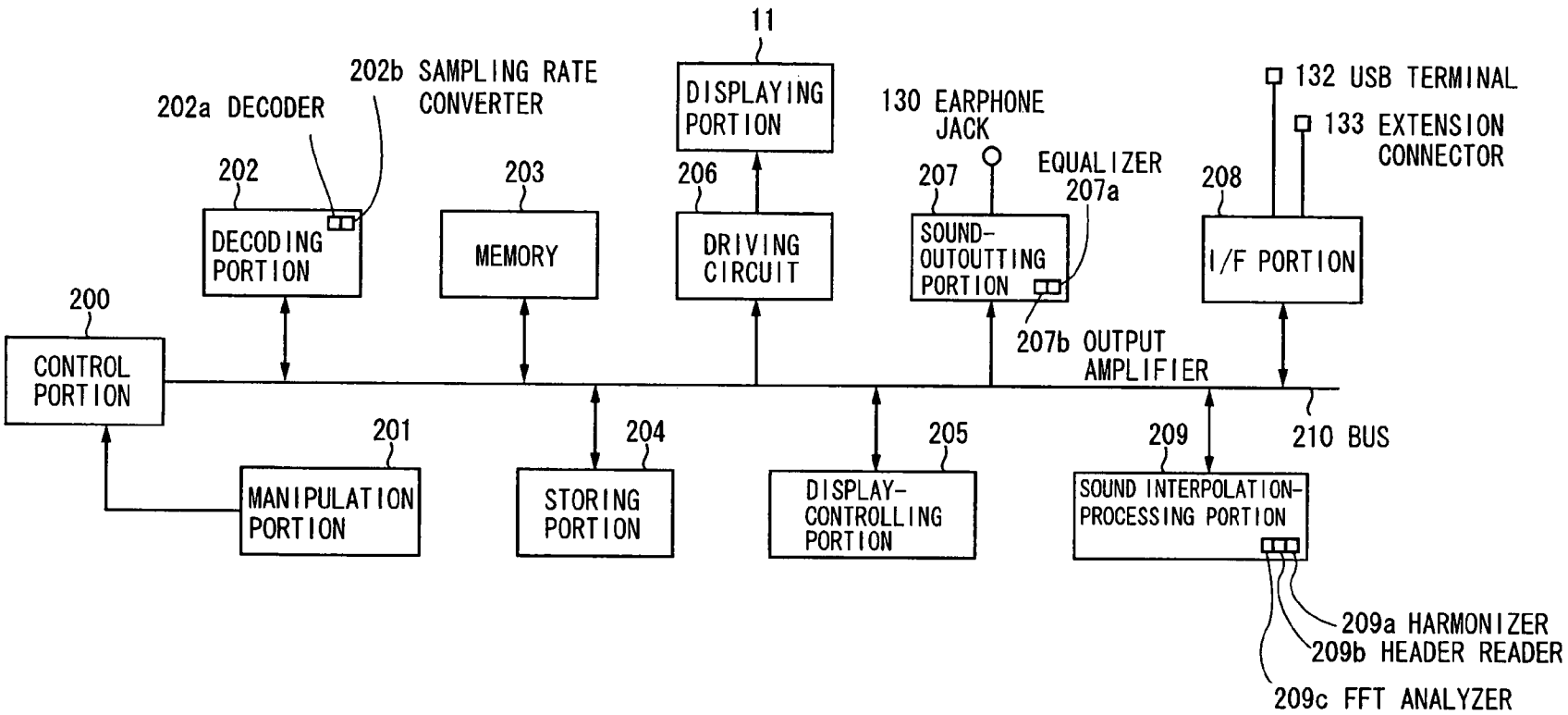
FIG. 2 is an exemplary block diagram showing a schematic configuration of the sound-reproducing apparatus according to the first embodiment of the present invention.

FIG. 2 is a block diagram showing a schematic configuration of the sound-reproducing apparatus 1 according to the first embodiment of the present invention.

A control portion 200 performs a clock function, file system management for contents such as an audio, control during execution of audio decoding processing, control for audio interpolation processing, a reproduction mode setting, an equalizer setting during reproduction of audio data, and user interface control.

A manipulation portion 201 outputs a manipulation signal corresponding to a manipulation for corresponding one selected among the switches provided in the sound-reproducing apparatus 1 to the control portion 200.

A decoding portion 202 includes a decoder 202*a* for converting compressed audio data into an audio signal, and a sampling rate converter 202*b* for converting a sampling rate for the audio data into another one.

A memory 203 stores temporarily therein a file of audio data or the like, and assists data processing in the portions.

A storing portion 204 stores therein firmware in accordance with which the sound-reproducing apparatus 1 is operated, management data required to manage contents such as an audio, a program required for the reproduction and the control, and contents data such as audio data.

A display-controlling portion 205 is systematized with respect to data of contents such as an audio, and menu items (audio, appli, setting) relating to a setting for clock display or the like, and controls image display on the displaying portion 11 by referring to the management data stored in the storing portion 204.

A driving circuit 206 controls drive of the displaying portion 11 by receiving as its input data corresponding to a displayed picture obtained in accordance with a user manipulation from the control portion 200 through a bus 210.

A sound-outputting portion 207 receives as its input an audio signal which is decoded in the decoding portion 202 through the bus 210, and sound-corrects the audio signal thus inputted thereto by an equalizer 207*a*. Then, the sound-outputting portion 207 outputs the resulting signal to the earphone jack 130 through an output amplifier 207*b* for converting digital data into analog data.

An interface (I/F) portion 208 has a USB terminal 132 and an extension connector 133, and when an external apparatus is connected to the sound-reproducing apparatus 1 through a USB terminal or the like (not shown), controls the bus 210 through which data on contents such as an audio is inputted/outputted.

A sound interpolation-processing portion 209 includes a harmonizer 209*a* for subjecting the audio signal after completion of the decoding to high frequency interpolation processing, a header reader 209*b* for reading out header information of the compressed audio data, and a fast Fourier transform (FFT) analyzer 209*c* for subjecting the audio data after completion of the decoding to first Fourier transform to analyze the audio data concerned.

[Operation]

An operation of the sound-reproducing apparatus 1 according to the first embodiment of the present invention will be described hereinafter with reference to FIGS. 1 to 4.

Figure 3:
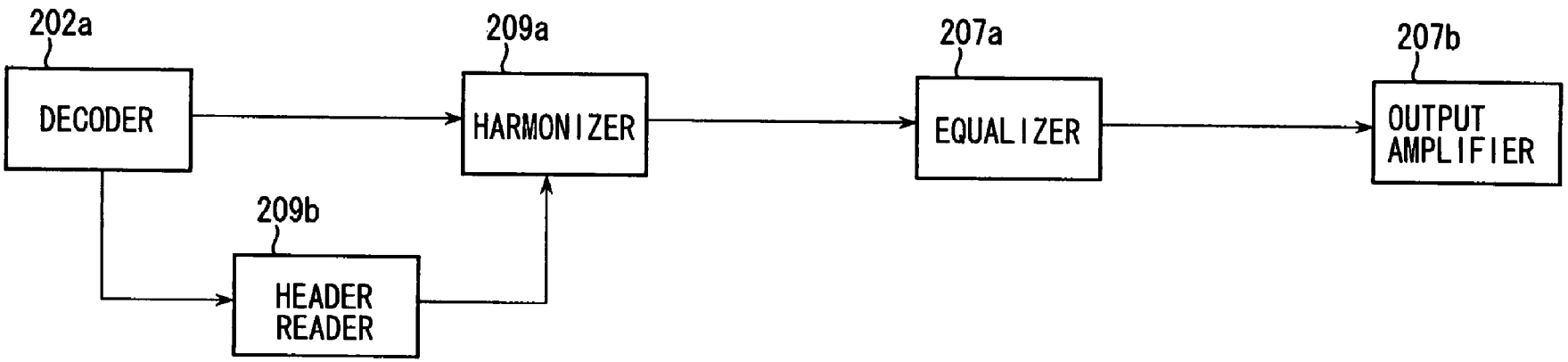
FIG. 3 is an exemplary block diagram showing sequence of an operation for executing high frequency interpolation processing of the sound-reproducing apparatus according to the first embodiment of the present invention.

FIG. 3 is a block diagram showing sequence of an operation for executing high frequency interpolation processing of the sound-reproducing apparatus 1 according to the first embodiment of the present invention.

The compressed audio data is decoded by the decoder 202*a* and the resulting audio signal is transmitted to the harmonizer 209*a*. Auxiliary information such as a sampling rate and a bit rate contained in the audio data is read out by the header reader 209*b*, and is transmitted to the harmonizer 209*a*. Communication of the signals from/to the respective portions is made through the bus 210.

Figure 4:
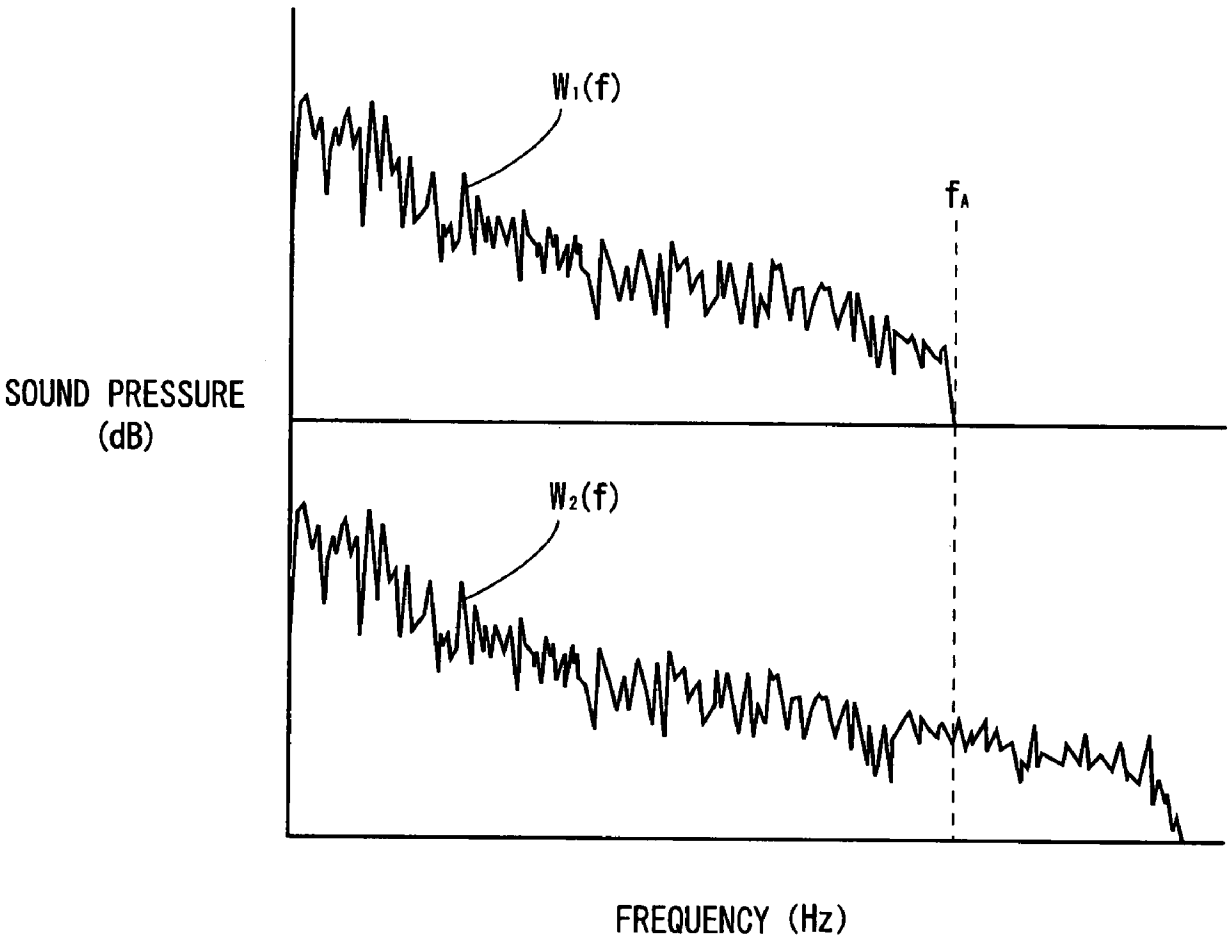
FIG. 4 is an exemplary characteristic diagram showing frequency components of a sound before and after execution of high frequency interpolation processing in the first embodiment of the present invention.

FIG. 4 is a characteristic diagram showing frequency components of a sound before and after execution of the high frequency interpolation processing in the first embodiment of the present invention.

In the figure, $W_1(f)$ represents frequency components of the audio signal before the high frequency interpolation processing is executed. Any of the frequency components each having a frequency higher than a frequency $f_A$ is lacked. Also, $W_2(f)$ represents frequency components of the audio signal after the high frequency interpolation processing is executed therefor. The interpolation is performed for the frequency components each having a frequency higher than the frequency $f_A$.

The harmonizer 209*a* has a preset for an interpolation band obtained in accordance with a format and a sampling frequency of the compressed audio data, and executes processing by referring to the file information transmitted thereto from the header reader 209*b*. For example, the harmonizer 209*a* does not subjects the non-compressed audio data having WAV, AIFF or the like to the high frequency interpolation processing, but performs the high frequency interpolation for the compressed audio data having WMA, MP3 or the like in correspondence to the sampling frequency. More specifically, when the file format is MP3 and the sampling frequency is 48 kHz, the harmonizer 209*a* interpolates the frequency components having a band in which the lowest frequency is equal to or higher than the frequency $f_A$ of 20 kHz and in which high frequencies of the frequency components are lacked. In addition, when the sampling frequency is 44.1 kHz, the harmonizer 209*a* interpolates the frequency components having a band in which the lowest frequency is equal to or higher than the frequency $f_A$ of 16 kHz. Also, when the sampling frequency is 22.05 kHz, the harmonizer 209*a* interpolates the frequency components having a band in which the lowest frequency is equal to or higher than the frequency $f_A$ of 12 kHz.

According to the first embodiment of the present invention, since the interpolation band is determined depending on the kind of file and the sampling frequency of the compressed audio data, it is unnecessary to read out the auxiliary information every frame, and thus the operation process is reduced, which results in reduction in burden imposed on the internal processing. In addition, reduction in operation process results in that the power consumption of the overall apparatus is suppressed.

In addition, since the high frequency interpolation processing is executed in the portions in the preceding stage of the equalizer 207*a*, the correction effect offered by the equalizer 207*a* more precisely appears.

Second Embodiment

An operation of a sound-reproducing apparatus according to a second embodiment of the present invention will be described hereinafter with reference to FIG. 5 and the corresponding figures.

Figure 5:
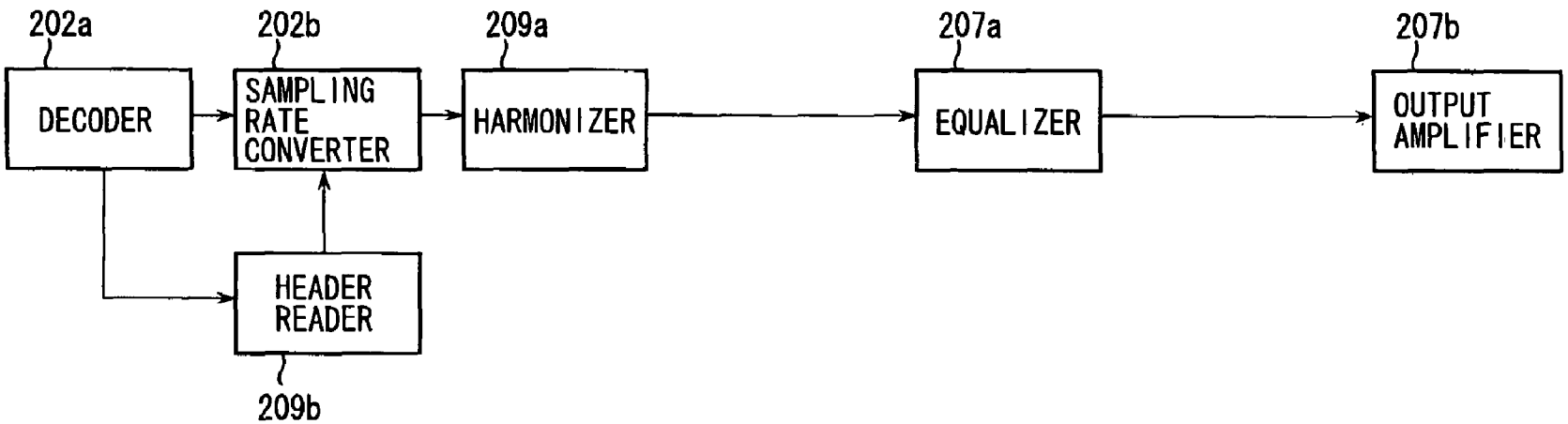
FIG. 5 is an exemplary block diagram showing sequence of an operation for executing high frequency interpolation processing of a sound-reproducing apparatus according to a second embodiment of the present invention.

FIG. 5 is a block diagram showing sequence of an operation for executing high frequency interpolation processing of the sound-reproducing apparatus according to the second embodiment of the present invention. Incidentally, in the following description, portions having the same constitutions and functions as those of the first embodiment are designated with the same reference numerals, respectively.

The compressed audio data is decoded by the decoder 202*a* and the resulting audio signal is transmitted to a sampling rate converter 202*b*. The auxiliary information such as the sampling rate contained in the decoded audio data is read out by the header reader 209*a* and is transmitted to the sampling rate converter 202*b*. The communication of the signals from/to the respective portions is made through the bus 210.

The sampling rate converter 202*b* converts uniformly the audio signal into another audio signal having a sampling frequency of 44.1 kHz by referring to the auxiliary information. The resulting audio signal obtained through the sampling rate conversion is transmitted to the harmonizer 209*a*. Then, the harmonizer 209*a* interpolates the frequency components having a band in which the lowest frequency is equal to or higher than $f_A$ of 16 kHz.

According to the second embodiment of the present invention, since the sampling frequency of the audio signal is converted into the fixed value, the setting for the interpolation processing executed in the harmonizer 209*a* is fixed, and thus the circuit burden imposed on the high frequency interpolation processing is lightened.

Third Embodiment

[Operation]

An operation of a sound-reproducing apparatus according to a third embodiment of the present invention will be described hereinafter with reference to FIG. 6 and the corresponding figures.

Figure 6:
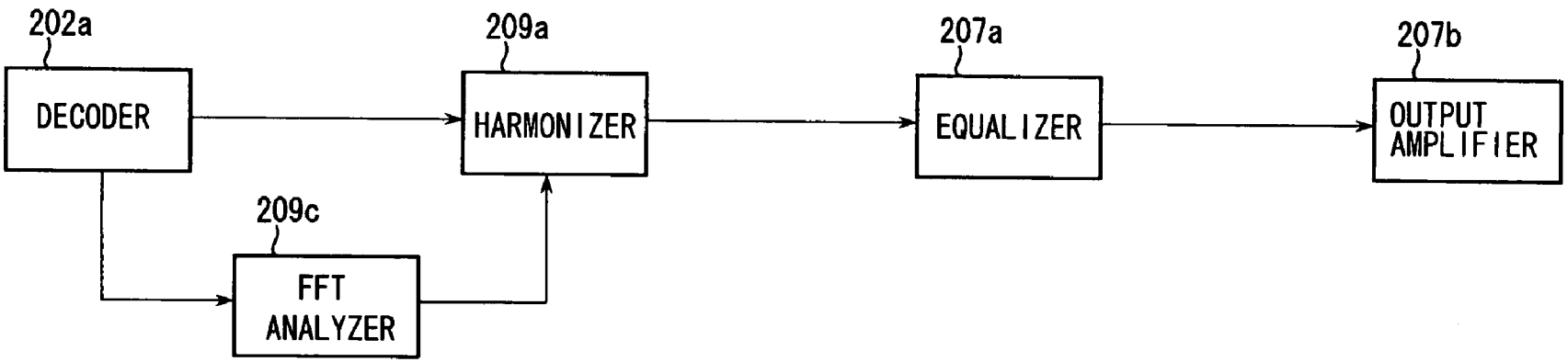
FIG. 6 is an exemplary block diagram showing sequence of an operation for executing high frequency interpolation processing in a sound-reproducing apparatus according to a third embodiment of the present invention.

FIG. 6 is a block diagram showing sequence of an operation for executing high frequency interpolation processing in the sound-reproducing apparatus according to a third embodiment of the present invention.

The compressed audio data is decoded by the decoder 202*a* and the resulting audio signal is transmitted to each of the harmonizer 209*a* and the FFT analyzer 209*c*. The FFT analyzer 209*c* can acquire the frequency $f_A$ on a real time basis by subjecting the audio signal received thereat to the fast Fourier transform. Then, the FFT analyzer 209*c* transmits the information on the frequency $f_A$ to the harmonizer 209*a*. The communication of the signals from/to the respective portions is made through the bus 210.

The harmonizer 209*a* has a preset, for the interpolation band, obtained in accordance with the format and sampling frequency of the compressed audio data, and executes the processing by referring to the file information transmitted thereto from the FFT analyzer 209*c*.

According to the third embodiment of the present invention, the audio signal is analyzed by using the FFT analyzer 209*c*, whereby it is possible to cope with the compressed audio data which is encoded at the variable bit rate or the like in which the frequency $f_A$ changed with time.

It should be noted that for the processing for the fixed bit rate other than the compressed audio data which is encoded in the form in which the frequency $f_A$ changes with time, the operation is performed in accordance with the switching so as to use the constitution described in the second embodiment, whereby it is possible to lighten a burden imposed on the circuit and caused by the high frequency interpolation processing.

What is claimed is:

1. A sound-reproducing apparatus, comprising:

a decoder for converting compressed audio data into an audio signal;

a header reader for reading file information from the compressed audio data; and a harmonizer for receiving the file information from the header reader, selecting a preset interpolation band by referring to the file information, and executing high frequency interpolation processing with respect to the interpolation band thus selected.

2. A sound-reproducing apparatus according to claim 1, wherein:

the harmonizer is installed in a preceding stage of a sound correction-processing portion constituted by an equalizer or the like.

3. A sound-reproducing apparatus, comprising:

a decoder for converting compressed audio data into an audio signal;

a header reader for reading file information containing a file format and a sampling frequency from the compressed audio data; and a harmonizer for receiving the file information from the header reader and executing high frequency interpolation processing with respect to a preset interpolation band in accordance with the file information.

4. A sound-reproducing apparatus according to claim 3, wherein:

the harmonizer is installed in a preceding stage of a sound correction-processing portion constituted by an equalizer or the like.

5. A sound-reproducing apparatus, comprising:

a decoder for converting compressed audio data into an audio signal;

a header reader for reading file information from the compressed audio data;

a sampling rate converter for converting the audio signal into another audio signal having a fixed sampling frequency in accordance with the file information; and a harmonizer for subjecting the audio signal received from the sampling rate converter to high frequency interpolation processing with respect to a preset interpolation band.

6. A sound-reproducing apparatus according to claim 5, wherein:

the harmonizer is installed in a preceding stage of a sound correction-processing portion constituted by an equalizer or the like.

7. A sound-reproducing apparatus, comprising:

a decoder for converting compressed audio data into an audio signal;

an FFT analyzer for determining an interpolation band by Fourier-transforming the audio signal; and a harmonizer for receiving information on the interpolation band from the FFT analyzer and executing high frequency interpolation processing in accordance with the interpolation band.

8. A sound-reproducing apparatus according to claim 7, wherein:

the harmonizer is installed in a preceding stage of a sound correction-processing portion constituted by an equalizer or the like.

9. A sound-reproducing apparatus, comprising:

a decoder for converting compressed audio data containing a fixed bit rate into a first audio signal and converting compressed audio data containing a variable bit rate into a second audio signal;

a header reader for reading file information from the compressed audio data containing the fixed bit rate;

a sampling rate converter for converting the first audio signal into a third audio signal having a fixed sampling frequency in accordance with the file information;

an FFT analyzer for determining a first interpolation band by Fourier-transforming the second audio signal; and a harmonizer for subjecting the third audio signal to high frequency interpolation processing with respect to a preset second interpolation band and subjecting the second audio signal to high frequency correction processing in accordance with the first interpolation band information on which is received from the FFT analyzer.

10. A high frequency interpolation-processing method, comprising the steps of:

decoding compressed audio data into an audio signal by a decoder;

reading a header contained in the compressed audio data by a header reader;

selecting a preset interpolation band by referring to information described in the header by a control portion; and executing high frequency interpolation processing with respect to the interpolation band thus selected.

11. A high frequency interpolation-processing method, comprising the steps of:

decoding compressed audio data into an audio signal by a decoder;

reading a header contained in the compressed audio data by a header reader;

converting a sampling rate for the audio signal into a fixed value by referring to information described in the header; and executing high frequency interpolation processing with respect to an interpolation band suitable for the fixed value.

12. A high frequency interpolation-processing method, comprising the steps of:

decoding compressed audio data into an audio signal by a decoder;

determining an interpolation band by Fourier-transforming the audio signal to analyze frequency components of the audio signal; and executing high frequency interpolation processing with respect to the interpolation band thus determined.

13. A high frequency interpolation-processing method, comprising the steps of:

decoding compressed audio data containing a fixed bit rate into a first audio signal by a decoder and decoding compressed audio data containing a variable bit rate into a second audio signal by the decoder;

reading a header contained in the compressed audio data containing the fixed bit rate by a header reader;

converting the first audio signal into a third audio signal having a fixed sampling rate by referring to information described in the header; determining a first interpolation band by Fourier-transforming the second audio signal to analyze frequency components of the second audio signal; and subjecting the third audio signal to high frequency interpolation processing with respect to a second interpolation band suitable for the fixed value, and subjecting the second audio signal to the high frequency interpolation processing with respect to the first interpolation band.

* * * * *